United States Patent [19]

Kramer

[11] 4,068,494

[45] Jan. 17, 1978

[54] POWER SAVING CAPACITY CONTROL FOR AIR COOLED CONDENSERS

[76] Inventor: Daniel E. Kramer, 2009 Woodland Drive, Yardley, Pa. 19067

[21] Appl. No.: 650,240

[22] Filed: Jan. 19, 1976

[51] Int. Cl.[2] ..... F25B 41/00

[52] U.S. Cl. ..... 62/196 B; 62/509; 62/DIG. 17

[58] Field of Search ..... 62/196 B, 509, 117, 62/DIG. 17

[56] References Cited

U.S. PATENT DOCUMENTS

| | | | |
|---|---|---|---|
| 3,398,785 | 8/1968 | Anderson | 62/196 B |
| 3,791,160 | 2/1974 | Sauitz et al. | 62/196 |
| 3,822,564 | 7/1974 | Nijo | 62/196 B |
| 3,905,202 | 8/1975 | Taft et al. | 62/196 B |

*Primary Examiner*—William E. Wayner
*Assistant Examiner*—Robert J. Charvat
*Attorney, Agent, or Firm*—Daniel E. Kramer

[57] ABSTRACT

A refrigerant flooding type capacity control for air cooled condensers used in compression type mechanical refrigeration systems where the liquid receiver is located in a bypass around the condenser so that the controlled heating, which is applied to the liquid refrigerant in the receiver to create the flooding effect, does not cause a warming of the cold liquid refrigerant leaving the condenser.

12 Claims, 4 Drawing Figures

POWER SAVING CAPACITY CONTROL FOR AIR COOLED CONDENSERS

BACKGROUND OF THE INVENTION:

1. Field of the Invention:

This invention relates to the field of mechanical refrigeration and within that field to the utilization of air cooled condensers located outdoors and subject to high and low ambient temperatures and to controls for these air cooled condensers which allow them to work at full capacity during high temperature conditions and cause them to work at such reduced capacity during low temperature conditions as required to maintain the condensing pressure and therefore the pressure of the liquid in the liquid line supply conduit at or above a predetermined minimum.

2. Description of the Prior Art:

FIG. 1 exemplifies the present state of the prior art in condenser capacity controls. The motor-driven compressor 1 discharges compressed refrigerant vapor through discharge line 20 to air cooled condenser coil 170 in which it is condensed to a liquid by the action of the fan 176 drawing cool air over the condenser coil. The cool, condensed liquid leaves the condenser coil by way of its outlet manifold 182 and travels by way of conduit 200 to receiver 60, where it collects in a pool 70 and then is transmitted via liquid line 110 and liquid solenoid 120 to one or more evaporators 150, each under the control of an expansion valve 140.

The expansion valve modulatingly controls the flow of refrigerant liquid to the evaporator 150, feeding just enough to keep the evaporator tubes fully flooded without any liquid over-spilling into suction line 160. The refrigerant vapor resulting from the evaporation of the liquid in evaporator 150 is conveyed to the compressor 1 by way of suction line 160 for recycling.

Liquid solenoid 120 in liquid line 110 allows and prevents flow of liquid refrigerant to expansion valve 140 in accord with the requirements of a thermostat or other system control device not shown. The condenser capacity control includes bypass line 50 connecting discharge line 20 and condenser outlet line 200 and three control valves: First: discharge line regulator 35, in discharge line 20 between the condenser inlet and the point where bypass line 50 is connected. This regulator is of the type which senses inlet pressure and tends to close when the pressure drops below its predetermined setting (usually 110 PSI for refrigerant 12). It tends to open fully when the pressure rises above its predetermined setting and it tends to throttle between open and closed position at intermediate pressures. Second: Control valve 40, installed in bypass line 50, is a spring-loaded check valve whose spring load prevents it from opening until the pressure differential across it has increased to 15 or more PSI. In the alternative, control valve 40 is an outlet pressure regulating valve set to sense the pressure at the receiver and to open when that pressure falls below the predetermined valve setting, (usually 110 PSI for R-12). Third: check valve 90, installed in condenser outlet line 200 between the condenser outlet manifold and the point where bypass line 50 connects. When the ambient temperature around the air cooled condenser is about or above 75° F, control valve 35 is open, control valve 40 is closed, check valve 90 is open, with the result that refrigerant vapor will freely enter the condensing coil 170 and the condensed refrigerant enter the receiver. Under this operating condition the condenser operates at essentially one hundred percent of its capacity and the head pressure which occurs is determined solely by the full condenser capacity, the load on it and the temperature of the air traversing the coil.

When the outdoor ambient drops to a temperature below approximately 75° F, the pressure in discharge line 20 drops below 110 PSI, the setting of valve 35. Valve 35 therefore begins to throttle toward the closed position. When the pressure in receiver 60 drops below 110 PSI, the predetermined setting of pressure regulator valve 40, it begins to open. Now, some of the discharge vapor, which under summer conditions would have flowed directly to condenser coil 170, is able to bypass the condenser coil by way of bypass line 50 into the receiver, where it mixes with and condenses in the cool liquid refrigerant leaving the condenser coil 170, raising its temperature to about 95°, the temperature that corresponds to the pressure setting of valve 40. Liquid refrigerant in condenser coil 170 cannot leave the condenser until its pressure is equal to or slightly above the pressure in the receiver. Therefore, the condensed liquid is retained in condenser coil 170 until a sufficient number of its tubes have been flooded with liquid refrigerant to reduce its condensing capacity to the point where the pressure has risen slightly above the receiver pressure. Then check valve 90 pushes open and the cool refrigerant flows from condenser 170 to the receiver. While flowing, it mixes with discharge vapor bypassed through conduit 50 and control valve 40 and is warmed to the desired 95° F temperature. The principle of operation of this system requires that all the liquid in the receiver by warmed, significantly reducing the refrigeration capacity of the system from the capacity it would have had if the liquid had not been warmed. All condenser capacity controls which flood the condenser must have enough extra refrigerant charged into the system initially to achieve this flooding. In the winter, the extra refrigerant resides in the condenser. In the summer this extra refrigerant is released from the condenser and resides in the receiver.

The receiver must have enough refrigerant holding capacity to store in the summer all of the refrigerant liquid required to flood the condenser coil 170 under the coldest conditions in the winter and still have some remaining space left over.

Power Economy

Power economy in a refrigeration system is achieved, all other operating characteristics being equal, when the compressor operates at the lowest head pressure. Winter controls which reduce the capacity of air cooled condensers are power-consuming since they cause the head pressure to be higher and therefore the power consumption of the compressor to be higher than apparently necessary. Expansion valves must have relatively small control orifices in order to function correctly during the high liquid pressures normally arising during summer conditions. If the orifice is too large under summer conditions, then the control of liquid flow will be uncertain and the performance of the system unsatisfactory.

Once the orifice has been correctly sized to operate satisfactorily under summer, high pressure conditions, the liquid pressure at the expansion valve inlet must be kept high under all other operating conditions in order to ensure that enough flow through the expansion valve occurs to provide an adequate supply of liquid refrigerant to perform the required cooling operation in the evaporator. This means that the liquid pressure must be artificially maintained if environmental conditions are such that the liquid pressure otherwise would drop. It is the function of condenser capacity controls to achieve this effect.

For each 10° F that the temperature corresponding to the discharge pressure of a compressor is higher than necessary, about 10% more power must be supplied to the compressor to achieve the same refrigerating effect. There are two major components to this increased power consumption. The first is the reduction in compressor pumping rate and increase in compressor shaft horsepower, caused by maintenance of a higher-than-necessary pressure differential across the compressor. The second relates to the enthalpy (heat content) difference between the refrigerant entering the evaporator and leaving it. When refrigerant liquid enters the evaporator, it picks up heat and in the process of evaporating to a vapor reaches its highest enthalpy (most heat-laden state). For each pound of refrigerant that traverses the evaporator the maximum refrigeration in the evaporator will be performed if the refrigerant liquid entering the evaporator has the lowest enthalpy. Naturally, warm liquid has higher enthalpy (heat content) than cold liquid. Therefore, the refrigerant enthalpy difference across the evaporator will be lower when warm liquid enters the expansion valve than when cold liquid does. For this reason, warming the liquid decreases the power efficiency of the system because the compressor motor must put in the same amount of energy for a given suction pressure and head pressure whether warm or cold liquid reaches expansion valve 140. A thermodynamic calculation shows that if n percent of power could be saved by allowing the compressor to operate with uncontrolled condenser and achieve its theoretical minimum head pressure, that approximately n/two percent of power could be saved if a condenser capacity control were provided which did not warm the liquid leaving the condenser but instead allowed the liquid refrigerant to reach expansion valve at approximately the same temperature as that to which it was cooled by the low temperature air traversing the condenser coil.

SUMMARY OF THE INVENTION

This invention provides a substantially constant pressure type capacity control for air cooled condensers in compression type refrigeration systems which allows the cold liquid refrigerant leaving the capacity-reduced condenser to flow to the expansion device without any warming effect imposed by the condenser capacity control system.

The invention achieves this effect by utilizing a receiver in a bypass line connecting the compressor discharge with the condenser outlet together with two control valves, a first valve installed in series with the receiver either at its inlet or its outlet, and the second, installed at the condenser inlet or outlet connection, coacting to allow or prevent vapor and liquid flow through the bypass.

Figure 1:
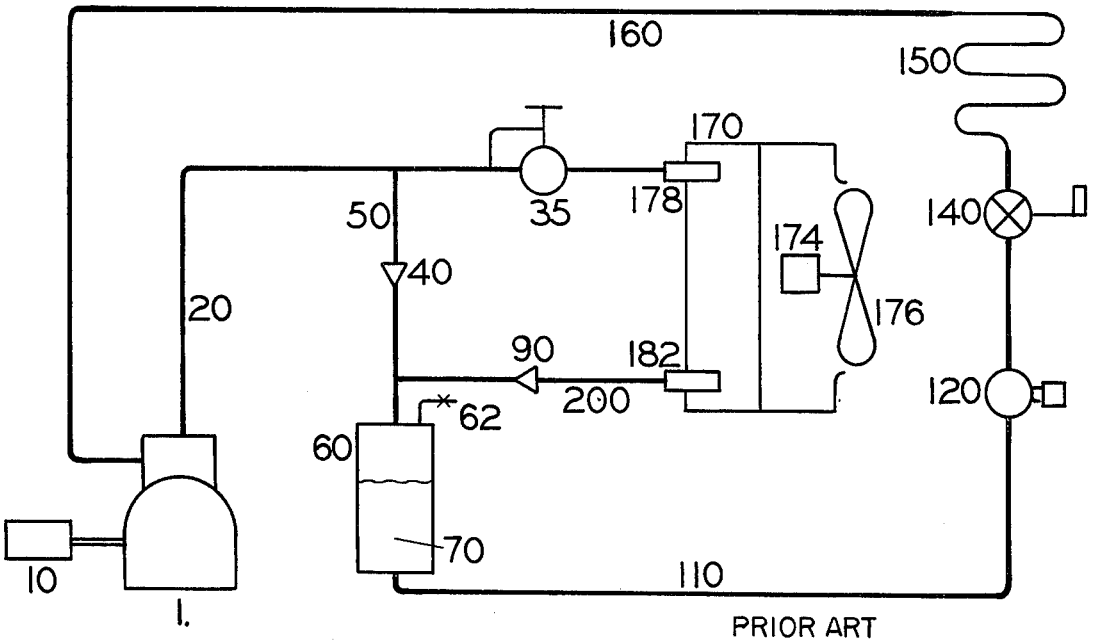
FIG. 1 is a schematic diagram of a compression type refrigeration system including an air cooled condenser and a capacity control system for the air cooled condenser of a type which is known and used in the refrigerating industry.

DETAILED DESCRIPTION OF THE PREFERRED EMBODIMENT:

FIG. 1 has already been explained in this specification under the heading PRIOR ART.

Figure 2:
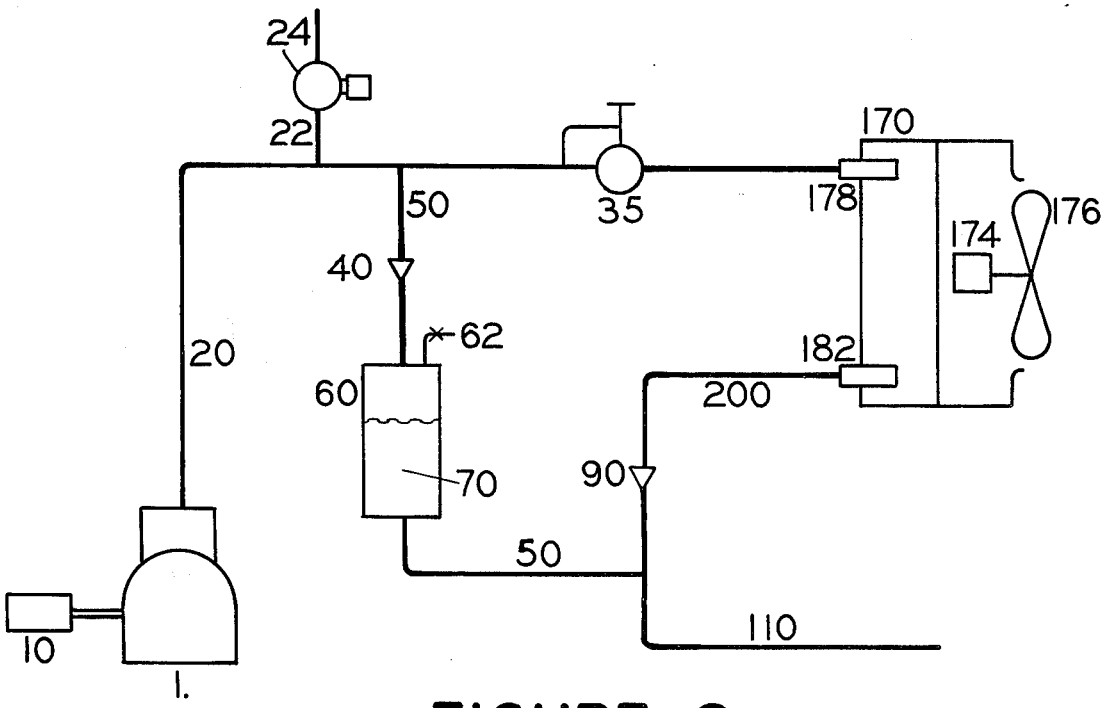
FIG. 2 shows one form of the invention in a refrigeration condensing system including an air cooled condenser and a condenser capacity control having a condenser bypass conduit, where the receiver is in the bypass and the primary condenser pressure control valve is in the condenser inlet conduit.

FIG. 2 is a schematic piping of the condensing section or high side of a complete refrigeration system embodying the principle of this invention.

In summer: compressor 1 is driven by compressor motor 10 and receives refrigerant vapor from suction line 160 and discharges it after compressing it to a higher pressure to discharge line 20, which conveys the refrigerant to the condenser inlet 178 via condenser capacity control valve 35.

Control valve 35 is an inlet pressure regulator which senses the pressure at its inlet, compares that pressure with a preset standard pressure. If the sensed pressure is much above the preset pressure, the valve opens wide. If the sensed pressure at its inlet is much below the preset pressure, the valve closes tight. The valve assumes intermediate or throttling positions under conditions where it senses intermediate pressures. Generally valve 35 is set to begin to throttle at inlet pressures corresponding to a saturated refrigerant temperature of 95° F. For refrigerant 12 this is approximately 105 PSI; for refrigerant 22, approximately 175 PSI. Under summer conditions, the pressure in discharge line 20 is well above these values and control valve 35, sensing these pressures higher than its setting, opens wide, allowing free and unrestricted flow of refrigerant to condenser 170. In the condenser 170 the refrigerant vapor is condensed to a liquid and leaves the condenser coil by its outlet 182 and liquid outlet conduit 200, traversing check valve 90, oriented to allow flow from the condenser and to prevent reverse flow, and entering liquid line 110, connecting the outlet of check valve 90 and the inlet of expansion valve/s not shown. Condenser bypass conduit 50 connects discharge line 20 from a point on the inlet side of pressure regulating valve 35 to a point in liquid line 110 at the outlet of check valve 90. In this bypass are located check valve 40 and receiver 60. Check valve 40 is a spring-loaded check valve whose spring pressure has been adjsted to allow the valve to open only when the pressure differential across it exceeds 15 PSI. In summer, when control valve 35 is fully open, the pressure drop across valve 40 remains much less than 15 PSI and it remains closed. Therefore, there is no flow out of receiver 60. Note that during summer operating conditions receiver 60 fills completely. Charging is carried out until a sightglass at the condenser outlet 182 or in liquid line 110 shows no bubbles. In summer, the amount of variation in system charge which can be tolerated is limited since extra high side charge resulting from pumpdown of satisfied evaporators must be stored in the limited volume in the tubes of condenser coil 170.

The storage of refrigerant in the condenser tubes, which is so desirable in the winter, is much to be avoided in summer since the summertime resulting condenser capacity reduction causes the summer condenser and head pressures to be higher than necessary.

In winter: The condenser coil is exposed to low ambient, the pressure in discharge line 20 tends to drop below the setting of regulating valve 35. This valve then throttles or closes in an effort to maintain the pressure at its inlet at or near its setting. As valve 35 throttles, it creates a pressure differential between its inlet and its outlet. This pressure differential is communicated to the ends of the bypass of conduit 50 connecting discharge line 20 and liquid line 110. When valve 35 has throttled sufficiently to cause spring loaded check valve 40 to open, discharge gas begins to flow through the bypass and enters receiver 60, displacing liquid refrigerant 70 stored in the receiver, causing the refrigerant to flow through the receiver outlet into the liquid line side of bypass 50 and into liquid line 110. This extra liquid is converted to vapor in the evaporator 150 and pumped by the compressor to the condenser 170 where it resides, partially filling the condenser tubes, reducing the access of the condensing refrigerant vapor to the inner heat transfer surfaces of the tubes and to that extent reducing the condensing capacity of the condenser coil. This reduction in condenser capacity causes a rise in the condensing pressure. When the condensing pressure reaches a value equal to that of the setting of control valve 35, it reduces its degree of throttling to such an extent that extra liquid 70 from receiver 60 is no longer fed into liquid line 110 and an essentially constant high side pressure is attained. At this condition of equilibrium there is essentially no flow of liquid refrigerant out of receiver 60 into liquid line 110. Therefore, even if condensing vapor entering the receiver though bypass 50 has warmed the liquid 70 within the receiver 60, the receiver will contain all of this warm liquid and will not transmit it to the liquid line. Consequently the cold liquid leaving condenser coil 170 will be transmitted through liquid line 110 directly in its cold state to the expansion valve 140 without being warmed to a temperature approaching the saturated temperature of the refrigerant in the high side.

Spring-loaded check valve 40, located in bypass 50 between discharge line 20 and the inlet of receiver 60, can be installed equally effectively at the receiver outlet (see FIG. 5).

The structure of FIG. 2 is ideally suited for use with hot gas defrost systems in which the evaporator is defrosted by compressed vapor from the compressor discharge. Conduit 22, controlled by solenoid valve 24, is tapped into discharge line 20 and provides a source of hot gas free of liquid refrigerant for a so-called "dry" defrost, i.e., a defrost in which minimum quantities of liquid are circulated through the system. The hot gas branch can also be tapped into liquid line 110, at the outlet of check valve 90, under conditions where relatively large quantities of liquid refrigerant are circulated through the evaporator and take part in the defrosting process.

For defrost, a timer, not shown, will cause solenoid 24 to open, connecting discharge line 20 with the cold low pressure evaporator. At that moment the pressure in discharge line 20 will drop. Control valve 35, sensing the sharp reduction in inlet pressure will close, preventing any flow of gas to cold condenser 70. Essentially no flow through bypass 50 and spring loaded check valve 40 will occur. Consequently, essentially the entire quantity of gas, pumped by compressor 1, will be conveyed to the evaporator for defrosting. A valve controlled hot gas conduit may also be connected to the liquid line at the outlet of check valve 90. On defrost the liquid 70 stored in receiver 60 and a portion of the liquid residing in condenser 170 and liquid line 110 flows to the evaporator. As soon as this liquid has traversed the evaporator, however, the pressure in the receiver 60 will approach evaporator pressure and the pressure in discharge line 20 will be equal to the evaporator pressure plus approximately the pressure drop in spring loaded check valve 40. This pressure will be well below the setting of discharge line regulator 35 and consequently it will close, forcing and channeling all of the vapor discharged by the compressor to bypass 50, spring-loaded check valve 40, receiver 60 and hot gas conduit 92 to the evaporator.

The structure of FIG. 2 also has the district advantage of providing instantaneous liquid line pressure on start-up in advance of flooding or pressurization of condenser 170. Under conditions of cold start, the entire high side pressure will be low and discharge line regulator 35 will be closed tight. Condenser outlet check valve 90 will be closed. Check valve 40 will be closed. At the instant the compressor starts, there will be only one route for discharge vapor and that is through discharge line 20, bypass 50, spring-loaded check valve 40 and into receiver 60, where the body of liquid stored will be subjected to the pressure of the discharge vapor. This pressurized liquid will communicate its pressure instantaneously to the liquid residing in liquid line 10 and therefore provide full and normal liquid line pressure at the inlet to the expansion valve of the refrigerating evaporator, essentially instantaneously on initiation of operation of the compressor 1. Even if the condenser 170 is empty and has a pressure very much lower than the pressure in liquid line 110 or discharge line 20, the closed regulator 35 and check valve 90 will prevent this reduced condenser pressure from affecting the liquid line pressure or delaying its rise. When the pressure in discharge line 20 approaches the setting of regulator 35, it will gradually open and meter a limited quantity of vapor into condenser 170 sufficient to prevent the pressure in discharge line 20 from rising over the setting of valve 35. Since the pressure within the condenser 170 is lower than the pressure in liquid line 110, the liquid condensed in the condenser 170 will not be able to leave it via check valve 90 until sufficient vapor has traversed the regulator 35 and condensed in the condenser 170 to fill it to the point where its condensing capacity has been reduced sufficiently that its equilibrium pressure is slightly greater than the pressure in liquid line 110. In that condition liquid refrigerant will begin to flow from condenser 170 into liquid line 110 through check valve 90, establishing a stable system operating condition.

Figure 3:
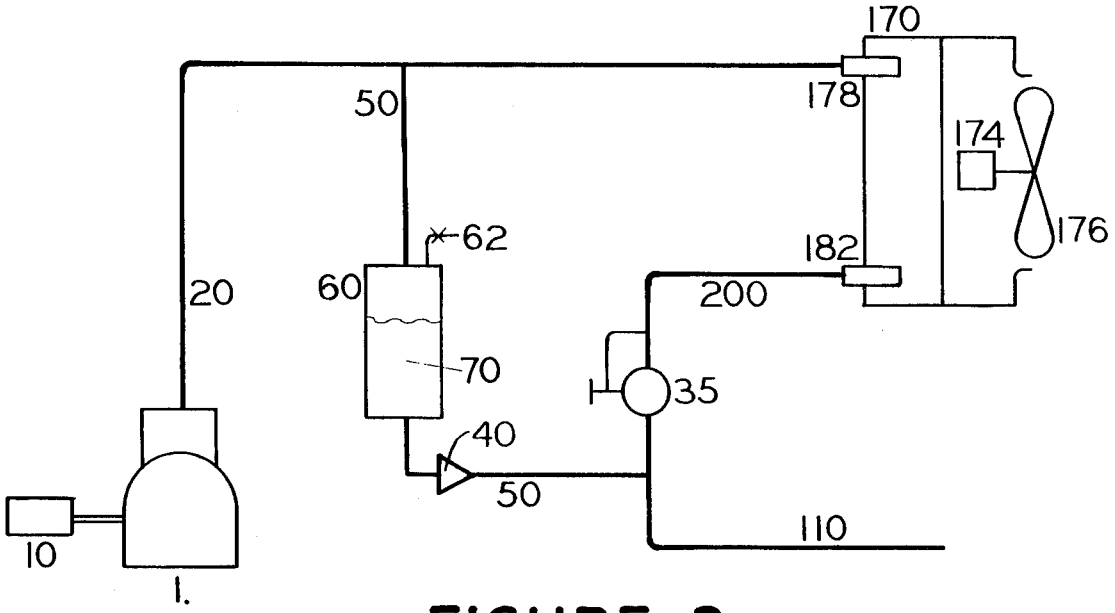
FIG. 3 shows a second form of the invention including air cooled condenser and with the receiver in the condenser bypass similar to that of FIG. 4 but where the primary condenser pressure control valve is in the condenser outlet conduit.

FIG. 3 is similar to FIG. 2 with the exception that the control valve 35 is not installed in discharge line 20 at the inlet to condenser 170 but instead is installed in outlet line 200 of the condenser 170 between the condenser outlet and the point where the bypass enters the liquid line 110, and check valve 40 is located at the receiver outlet. The performance of this system under summer conditions is identical to that of FIG. 2. Under winter conditions, when the pressure in the discharge line 20 falls to a level below the setting of control valve 35, this reduced pressure is communicated through condenser 170 to the condenser outlet, at which point it affects valve 35, causing it to throttle toward a closed position. This increases the pressure drop across bypass 50 to the point where valve 40 pushes open, allowing liquid refrigerant 70, stored in the receiver 60, to flow out of the receiver through the condenser outlet portion of bypass 50 into liquid line 110 and eventually into condenser coil 170 where it logs the condenser tubes. The advantage of this control system of FIG. 3 over the system in FIG. 2 is that control valve 35 when located at the condenser outlet need be very much smaller and lower cost for a given tonnage since it need pass only liquid refrigerant.

Figure 4:
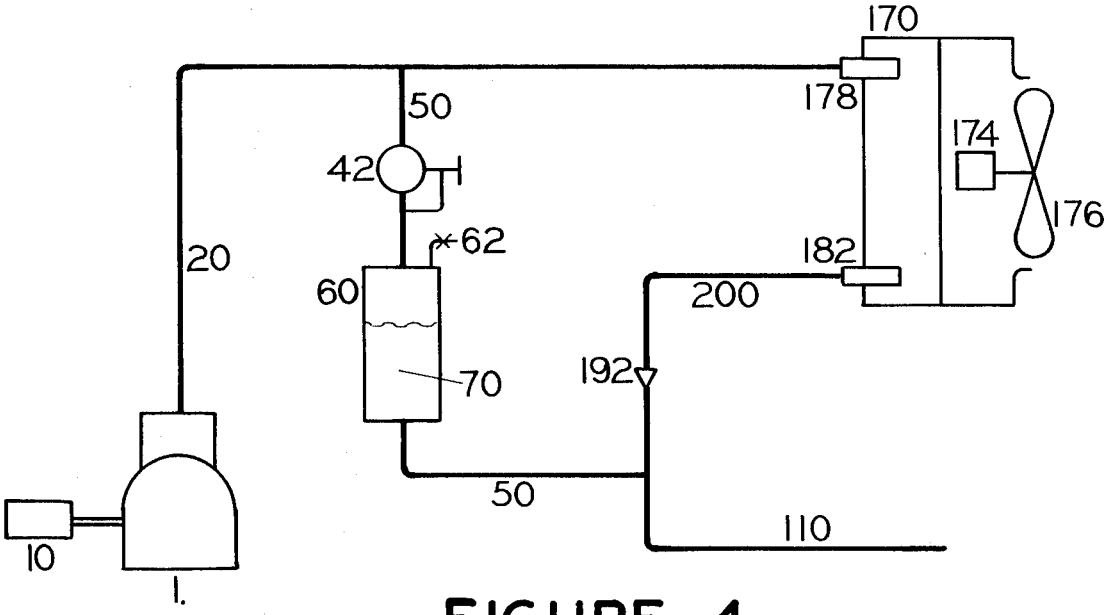
FIG. 4 shows a third form of the invention including air cooled condenser and a condenser capacity control system where the primary condenser pressure control valve is in the condenser bypass in series with the receiver.

FIG. 4 shows a schematic piping diagram of the high side of a refrigeration system embodying the principle of the invention which includes a bypass 50 connecting discharge line 20 at the inlet of condensing coil 170 and liquid line 110 at the outlet of condensing coil 170 which includes the receiver 60. There is a control valve 42 installed in this bypass line at the inlet of the receiver in bypass 50. There is a pressure drop producing element 192 in the condenser outlet line 200 between outlet manifold 182 and the point where the terminus of the bypass 50 containing receiver 60 joins the condenser outlet line. Element 192 is a spring-loaded check valve which has a built-in pressure drop of between 4 and 15 PSI. This valve remains in the line under both summer and winter conditions. So long as the pressure drop does not exceed approximately 15 PSI, for the common high pressure refrigerants, such as R12, R22 and R502, this spring-loaded check valve will not affect summer operation of the condenser; that is, under summer conditions, it will not itself cause any flooding in condenser coil 170 which would tend to cause condenser 170 to operate at lower than normal capacity. Spring-loaded check valve 192 is not intended to act as a check valve; that is, to prevent back flow; an equivalent restriction, such as an orifice or a length of reduced internal diameter tubing, whose dimensions are selected to produce a pressure drop within the same range, would be as effective. Control valve 42 is different from inlet pressure regulator type control valve 35 shown in FIGS. 2 and 3, since control valve 42 is an outlet pressure regulator. It sense the pressure at its outlet and compares that pressure with a preset standard pressure. Vavle 42 opens wide if the sensed outlet pressure in much lower than its setting. It closes tight if the sensed pressure is much higher than its setting; and it assumes a throttled, or partially open, position if the value of the sensed pressure is close to its setting.

In FIG. 4, during summer conditions, the pressure in the condenser is sufficiently high that the pressure in the receiver and in liquid line 110, is substantially higher than the setting of valve 42. That valve is therefore fully closed and allows no vapor to flow to receiver 60 from discharge line 20. As the ambient temperature at condenser coil 170 drops, the pressure in the condenser and at its outlet also drops. When the pressure in liquid line 110, and therefore receiver 60, approaches the setting of valve 42, that valve begins to open, allowing the flow of discharge vapor into the receiver 60, warming the liquid therein, and forcing some of the liquid 70, contained in it, to flow through its outlet line 50 into liquid line 110, augmenting the supply in the main flow stream, and increasing the pressure at the outlet of check valve 192 so that liquid which has condensed in condenser coil 170 cannot leaves via the outlet connection 182 but must remain trapped in the condenser until sufficient liquid has collected to reduce the condensing surface and therefore the condenser capacity to the point where the condensing pressure inside the condenser coil has risen sufficiently high to cause valve 42 to again close.

Actually, the process of flooding condenser 170 does not result in the diminution of flow toward the expansion device through liquid line 110 since any deficit in the amount of refrigerant flow required for full feeding of the expansion device from condenser outlet connection 182 is made up in full by the flow of liquid refrigerant 70 out of receiver 60 through its outlet connection 50 and into liquid line 110. When the pressure in the condenser, and therefore in liquid line 110, rises above the valve setting because of an increase in ambient temperature, valve 42 remains closed and liquid refrigerant simply pushes backward from liquid line 110 into receiver 60, refilling the receiver to reach the condition where condenser 170 operates at its full capacity unflooded condition.

While typical embodiments of the present invention has been shown in the drawing and described above it will be apparent that the invention is capable of many other modifications and changes without departing from the spirit and, principle of the invention. In view thereof it should be understood that the forms of the invention specifically disclosed herein are intended to be illustrative only and are not intended to limit the scope of the invention expect as defined in the claims.

I claim:

1. An improved compression type refrigeration system including a compressor having a discharge conduit; air cooled condenser means for receiving refrigerant from the discharge conduit and condensing it, said condenser means having an inlet and an outlet, said condenser means adapted to be exposed to varying ambients; an expansion device and an evaporator; a bypass conduit having a first end connected to the compressor discharge conduit, a condenser circuit comprising an inlet conduit joining one end of the bypass conduit with the condenser inlet, the condenser means, and an outlet conduit joining the other end of the bypass conduit with the condenser outlet; receiver means connected into the bypass conduit between the first end and the other end; single pressure regulator valve means adapted to cause flow through the bypass conduit and receiver when the high side pressure is lower than a predetermined minimum and to prevent said flow when the high side pressure is higher than said minimum.

2. An improved refrigeration system as in claim 1 which includes a check valve in the bypass conduit.

3. An improved refrigeration system as in claim 2 where the regulator valve is in the condenser circuit.

4. A system as in claim 3 where the regulator valve in the condenser circuit is in the inlet conduit.

5. A system as in claim 3 where the regulator valve in the condenser circuit is in the outlet conduit.

6. An improvement as in claim 3 where the check valve means is in the bypass conduit at the receiver inlet.

7. An improvement as in claim 3 where the check valve means is in the bypass conduit at the receiver outlet.

8. An improvement as in claim 3 where the regulator valve means senses pressure at its own inlet and acts to close when said pressure falls below a predetermined setting.

9. An improvement as in claim 8 which includes check valve means in the condenser outlet conduit.

10. An improvement as in claim 9 which includes hot gas defrost means for achieving defrost of the evaporator.

11. An improvement as in claim 10 where the defrost means includes a conduit connecting the compressor discharge conduit with an evaporator inlet.

12. An improvement as in claim 10 including liquid line means for conveying condensed refrigerant from the condenser means and the receiver means to the expansion device where the defrost means includes a conduit connecting the liquid line means to an evaporator inlet.

* * * * *